United States Patent [19]

Beukema et al.

[11] 4,324,382

[45] Apr. 13, 1982

[54] HEIGHT ADJUSTABLE CHAIR BASE

[75] Inventors: Duane M. Beukema, Grand Rapids; Jack R. Knoblauch, Byron Center, both of Mich.

[73] Assignee: Steelcase Inc., Grand Rapids, Mich.

[21] Appl. No.: 50,660

[22] Filed: Jun. 21, 1979

[51] Int. Cl.[3] ..... A47C 3/24

[52] U.S. Cl. ..... 248/406

[58] Field of Search ..... 248/405, 406, 415–418, 248/423

[56] References Cited

U.S. PATENT DOCUMENTS

| | | | |
|---|---|---|---|
| 2,026,298 | 12/1935 | Bowman | 248/406 |
| 2,702,075 | 2/1955 | Richards | 248/405 |
| 3,164,357 | 1/1965 | Hage et al. | 248/406 |
| 3,385,550 | 5/1968 | Doerner | 248/405 |
| 3,391,893 | 7/1968 | Doerner | 248/405 |
| 3,642,244 | 2/1972 | Textoris | 248/406 |
| 3,778,014 | 12/1973 | Driscoll, Jr. | 248/406 |
| 3,799,485 | 3/1974 | Wolters | 248/406 |
| 3,870,270 | 3/1975 | Holtz | 248/406 |
| 3,870,271 | 3/1975 | Bowman | 248/406 |
| 3,991,965 | 11/1976 | Westover | 248/406 |
| 4,026,509 | 5/1977 | Wolters | 248/406 |
| 4,046,348 | 9/1977 | Goodwin | 248/423 |
| 4,087,070 | 5/1978 | Hancock | 248/406 |

FOREIGN PATENT DOCUMENTS 1226763 3/1971 United Kingdom .

*Primary Examiner*—William H. Schultz

*Attorney, Agent, or Firm*—Price, Heneveld, Huizenga & Cooper

[57] ABSTRACT

The specification discloses a compact, easy to assemble, height adjustable chair base in which a column telescopically received within a hub tube includes a spring and nut assembly located within the bottom of the column and carried on a threaded post fixedly secured and projecting upwardly within the hub tube. A spring housing is rotatably carried within the column and the top abuts against an abutment shoulder located within the column. The spring is located within the spring housing and both the spring and spring housing bear down on a washer which in turn bears down on the nut. The column includes portions extending around and below the nut, includes detent means located on the column below the nut which disengage the nut when a person sits on the chair, but which is biased upwardly towards engagement with the nut by the action of the spring when the chair is unoccupied. When the chair is unoccupied, rotation of the chair will cause the nut to rotate upwardly or downwardly on the threaded post.

29 Claims, 11 Drawing Figures

HEIGHT ADJUSTABLE CHAIR BASE

BACKGROUND OF THE INVENTION

The present invention relates to chair bases, particularly height adjustable chair bases. The most common type of height adjustable chair bases comprises a threaded post extending downwardly from the chair seat being threaded in a nut which in turn is rotatably carried on top of a hub tube. To adjust the height of the chair, one grasps the nut assembly with one hand and rotates the chair with the other.

One problem with such a chair base is that the threaded spindle is rather unsightly in appearance when the chair is adjusted in one of its higher positions. Also, the spindle has to be very large in diameter in order to be sufficiently strong to take the lateral loads which are imposed upon it when a person sits in the chair, particularly when a person leans back in the chair. The threaded spindle must also be greased and hence is sometimes the source of contamination of carpeting or a person's clothing. It is also somewhat cumbersome to adjust the height of the chair in that one has to reach under the chair, grasp the nut and then try to rotate the chair without getting hit in the chin.

Some chain braces, such as that disclosed in U.S. Pat. No. 3,799,485 to Wolters seek to eliminate the exposed threaded spindle by providing a column extending downwardly from the chair seat and being telescopically received within the hub tube. The column includes a nut located in the bottom thereof which is threaded on a threaded post extending upwardly within the hub tube. Normally, the threaded post and the nut rotate together as a person rotates his chair. However by reaching under the chair base and pushing upwardly on a button, one can lock the threaded post against rotation. Then one can rotate the chair and the nut will thread upwardly or downwardly on the threaded post. This type of mechanism is generally complicated and is not particularly economical to assemble. Further, it is generally considered somewhat cumbersome to use this mechanism in that one still has to reach clear under the chair base, depress the button and then rotate the chair, again trying to avoid getting hit in the chin by the rotating chair.

Others have developed devices which include some form of spring biased detent means which allow you to adjust the height of the chair by simply rotating the unoccupied chair. One does not have to reach under the chair and grasp any part of the base or push any buttons. Yet when one sits in the chair, the detent means is disengaged from either the threaded spindle or nut such that upon rotation of the chair, the height of the chair does not change. Two examples of many such devices include Richards U.S. Pat. No. 2,792,975 and Bouman U.S. Pat. No. 2,026,298.

Typically, these mechanisms involve the use of a threaded spindle extending downwardly from the chair seat, and therefore have the unsightliness, grease and strength problems cited above. Sometimes cover tubes are employed to try to hide the threaded spindle. However such mechanisms have typically been very complicated and difficult to assemble. Alternatively, it is difficult to design them without creating strength problems.

Thus, there has long been a need for a height adjustable chair base which can be adjusted by rotating the seat when it is unoccupied without having to reach under the seat and grasp some portion of the chair base, which can be easily and economically assembled, which does not incorporate inherent strength limitations and which avoids the employment of a threaded post extending downwardly from the chair seat.

SUMMARY OF THE INVENTION

These problems are solved by the present invention in which a seat supporting column, as distinguished from a threaded spindle, is telescopically positioned within a hub tube and which carries a spring assembly and a nut within the base of the column, the nut being threaded on an externally threaded post which is located within the hub tube and which is fixed against rotation with respect thereto. The spring assembly is located between an abutment means within the column and the nut such that the spring assembly tends to bias the column upwardly relative to the nut. The column includes portions which extend downwardly outside of the nut to a point below the nut. The downwardly extending column portions include detent means positioned below the nut and the nut includes detent receiving means. When the chair is unoccupied, the spring biases the column upwardly and the detent means engage the nut. When the chair is thereafter rotated relative to the chair base, the nut will thread upwardly or downwardly on the threaded post.

As a result, one does not have to reach under the chair in order to hold the chair base. One can simply block one of the legs of the chair base with his foot to prevent the base from rotating with the chair. Further, the supporting column offers tremendous strength to handle the lateral forces which are imposed upon it and yet provides a smooth, attractive visible surface. No cover tube is needed. The threaded post located within the hub tube does not have to carry lateral forces since they are absorbed between the column and the hub tube. Thus, the threaded post can be relatively thin in diameter and much less expensive than the usual threaded chair spindle.

The entire assembly is very economical to assemble in that the spring assembly and nut can be fitted onto the threaded post and then assembled to the column and locked in place by assembling the detent means. This assembly can then be quickly fitted into the hub tube with its projecting base legs already secured thereto. The threaded post can be secured to the hub tube by quick fastening connector means or the like.

These and other objects, advantages and features of the invention will be more fully understood and appreciated by reference to the written specification and appended drawings.

DESCRIPTION OF THE PREFERRED EMBODIMENT

Figure 1:
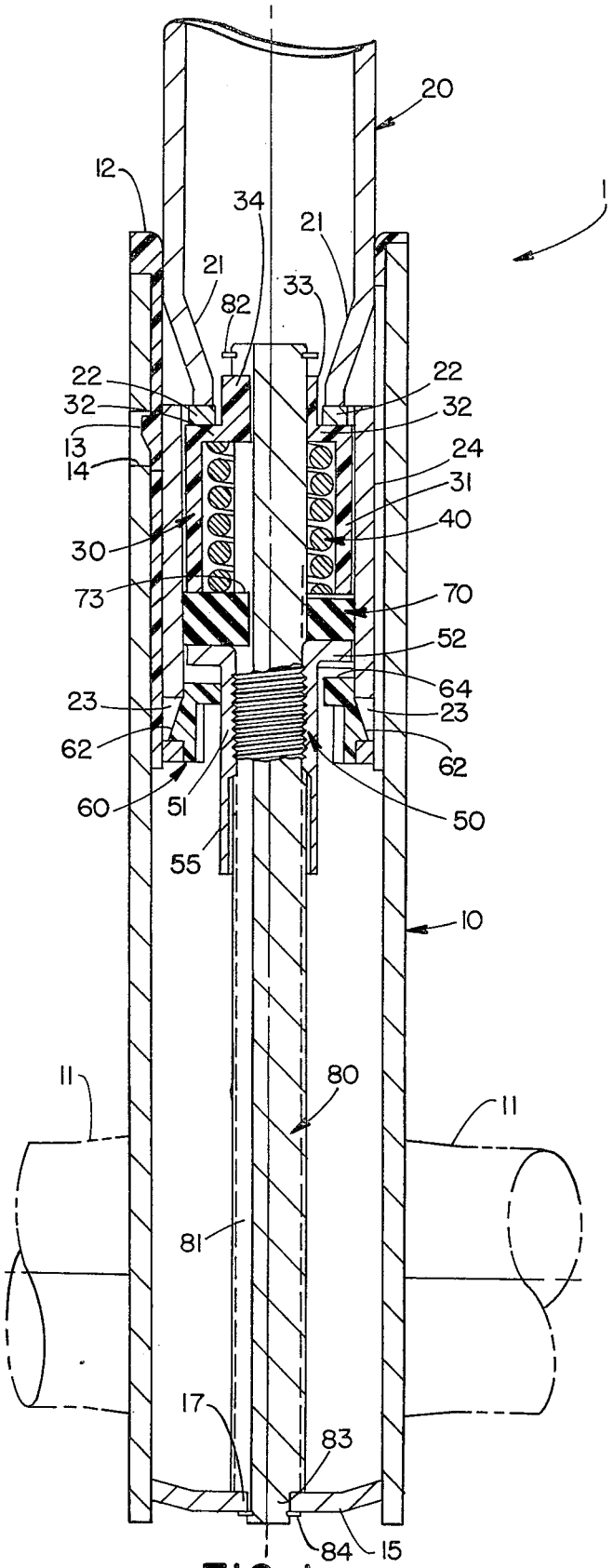
FIG. 1 is a cross sectional view of a chair base made in accordance with the present invention with the radiating legs shown fragmented and with the upper portion of the seat supporting column broken away.

The preferred embodiment base 1 (FIG. 1) comprises a seat column 20 telescopically carried within a hub tube 10. Captured within column 20 at the bottom thereof between an abutment shoulder washer 22 and a nut 50 are a spring housing 30, a spring 40 located therein and a bias washer 70 which is positioned between nut 50 on the one hand and spring 40 and spring housing 30 on the other. The bottom cylindrical portion 24 of column 20 extends past spring housing 30 and on down past the outside of nut 50. A detent ring 60 is snapped into the bottom of column 20 for selectively engaging or disengaging the underside of nut 50. Nut 50 is threaded onto upright threaded post 80 which is positioned within hub tube 10 and which is fixed against rotation with respect thereto.

Hub tube 10 is generally conventional for chair base structures. It comprises a cylindrical tubular member. Four or five legs 11 are welded thereto and project generally, radially outwardly therefrom. A plastic liner 12 is snap fitted into the upper portion of hub tube 10 by means of a liner locking prong 13 which snaps into position within an aperture 14 in hub tube 10. Liner 12 is made of a so called self lubricating plastic material which provides a low friction surface against which seat column 20 can rest snugly and rotate.

Hub tube 10 is closed at its bottom by a bottom cap or washer 15. Bottom cap 15 includes an aperture through which stem 83 of threaded post 80 extends. Bottom cap 15 also includes an inwardly projecting tab or key 17 which fits into a vertical slot 81 in post 80 so as to hold threaded post 80 against rotation with respect to hub tube 10.

In the manufacture of base 1, hub tube 10 and its attached legs 11 represent one subassembly. They can readily be welded together and finished by suitable finishing means. Casters or glides can be attached to the ends of legs 11 and the resulting subassembly is ready for simple and straight forward combination with the remaining components of base 1 which would also have been previously subassembled.

Of the remaining components, seat column 20 comprises a tubular member which is shaped at its upper end for joining to the seat portion of a chair, or more accurately to a chair control which in turn is secured to the bottom of a chair seat. The upper portion of seat column 20 is not shown since the structure is generally conventional in nature. Seat column 20 is tubular steel member having a smooth exterior surface such that it is attractive to the eye. That exterior surface can be finished in the same way as the exterior surface of hub tube 10 such that when one looks at a chair utilizing base 1, one has the impression of an attractive, single column supporting the chair. In the broader aspects of the invention a telescopic bell could be used to cover seat column 20, but its use is not required.

Tubular seat column 20 is open at its bottom so that the remaining components of base 1 can readily be assembled therein. Seat column 20 is lanced on either side at 21 and a shoulder washer 22 is inserted therein so as to abut the bottom edges of lances 21. Shoulder washer 22 is a washer which is readily welded in place to column 20 from the exterior thereof by running a weld bead through the small exterior opening created by the lances 21 on either side of column 20. Shoulder washer 22 is slightly narrower in diameter than the interior diameter of column 20 so that some of the weld bead will extend directly between the inside surface of column 20 and the outside surface of shoulder washer 22.

Seat column 20 includes a bottom portion 24 below lances 21 which include small apertures 23 in either side thereof and quite near the bottom thereof. These serve as locking apertures for holding detent ring 60 in place.

Figure 10:
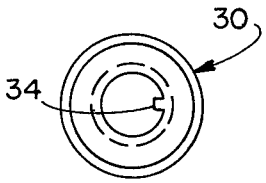
FIG. 10 is a top plan view of the spring housing.
Figure 9:
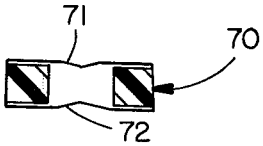
FIG. 9 is a cross sectional view of the biasing washer which is interposed between the spring means and the nut within the supporting column.
Figure 11:
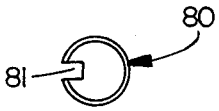
FIG. 11 is a top plan view of the threaded post.

Spring housing 30 is preferably molded of plastic and is shaped somewhat like an inverted cup. It includes a cylindrical body 31 having a top shoulder 32 for abutment against shoulder washer 22. A collar 33 extends upwardly from shoulder 32 and is narrower in diameter than the cylindrical body 31 of housing 30. Collar 33 slides up and down the length of threaded post 80 and helps to keep housing 30 in proper alignment. Collar 33 includes an inwardly projecting tab or key 34 (FIGS. 1 and 10) which slides up and down within groove 81 in threaded post 80 (FIGS. 1 and 11). This holds spring housing 30 against rotation with respect to threaded post 80 and with respect to hub tube 10 and insures that rotation of the chair when occupied will take place between bearing surface 32 and shoulder 22.

Spring 40 is a conventional coil spring which is selected to fit relatively snuggly within the spring housing 30. Spring 40 must be sufficiently soft that when a person sits in a chair mounted on top seat column 20, it will compress into the condition shown in FIG. 1. Yet, spring 40 must be sufficiently stiff that when the chair seat is unoccupied, column 20 is biased upwardly and detent ring 60 is brought into engagement with the underside of nut 50.

Figure 3:
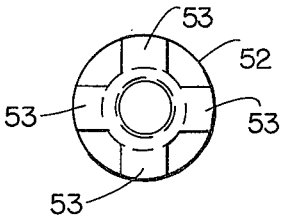
FIG. 3 is a top plan view of the nut.
Figure 4:
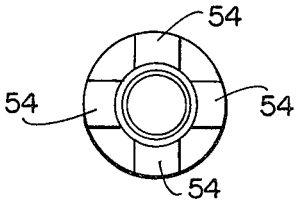
FIG. 4 is a bottom plan view of the nut.
Figure 5:
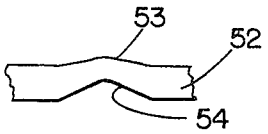
FIG. 5 is a fragmentary side elevational view of the nut flange.
Figure 2:
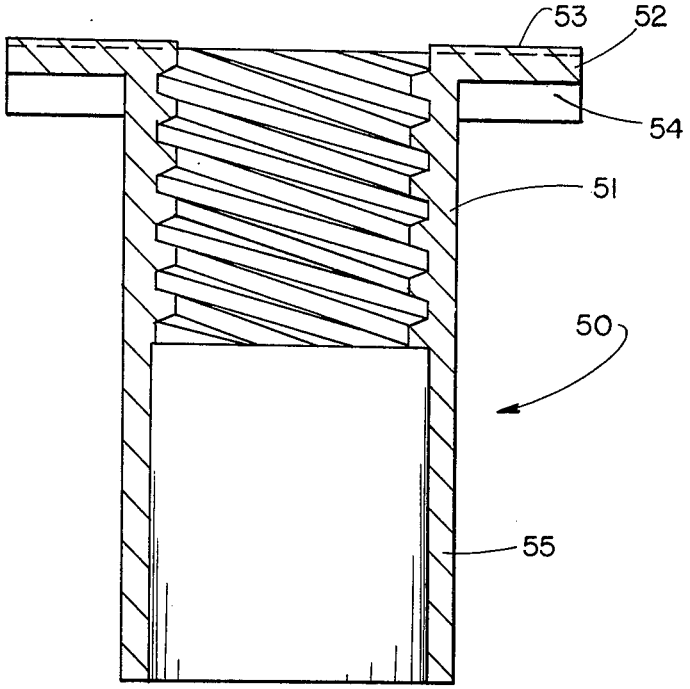
FIG. 2 is a lateral cross sectional view of the nut employed in the present invention.
Figure 8:
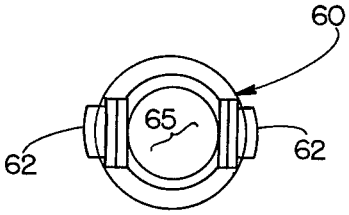
FIG. 8 is a bottom plan view of the detent means.

Nut 50 is cast of powdered metal or is forged steel. It has a generally T-shaped cross section (FIGS. 1 and 2). It includes an internally threaded cylindrical body 51 which threads up and down on the threads of threaded post 80. Projecting radially from the top of internally threaded body 51 is a top flange 52 which has both an irregular top surface created by slight protrusions 53 and an irregular bottom surface created by somewhat deeper detent receiving deviations 54 (FIGS. 3, 4 and 5). An idea of the relative dimensions of these projections and deviations can be gathered by reference to FIG. 5.

Projecting downwardly from internally threaded body portion 51 is an apron 55 which serves as a bottom stop for limiting the downward motion of nut 50. It also assists in assembly since when one slips nut 50 over the top of threaded post 80, the relatively long apron 55 helps insure that the internal threads of body portion 51 will get a proper start on the thread of post 80. The threads could also extend the full length of apron 55 and may in a commercial embodiment.

Detent ring 60 is preferably molded of plastic having some flexibility so that it can be snapped into its appointed position. Detent ring 60 includes small lock prongs 62 which project outwardly from either side thereof (FIGS. 1 and 6–8). Detent ring 60 is slotted (at 61) from the bottom almost to the top on either side of each lock prong 62 so that the lock prong 62 will readily deflect inwardly. In this regard, the upper surfaces of lock prong 62 are gradually sloped to define a camming surface while the bottom surfaces are flat and horizontal. As a result, one can readily insert detent ring 60 into the bottom portion 24 of seat column 20 by pushing it in through the open bottom thereof, lock prongs 62 being forced inwardly as one slides detent ring 60 up into place. When lock prongs 62 reach apertures 23 in seat column 20, they will snap back outwardly and project into apertures 23, thereby locking detent ring 60 in place.

Figure 7:
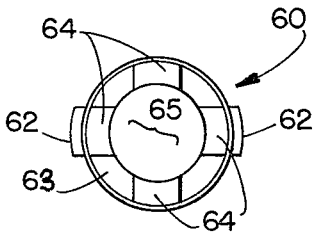
FIG. 7 is a top plan view of the detent means.
Figure 6:
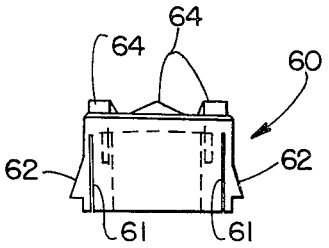
FIG. 6 is a side elevational view of the detent means.

Detent ring 60 includes a top surface which comprises an inwardly turned flange 63 (FIG. 7). It includes an opening 65 therein such that threaded spindle 80 can pass therethrough. Four regularly spaced detent projections 64 project upwardly from upper flange 63. These upwardly projecting detents 64 have configurations which match the detent receiving deviations 54 in the bottom of nut flange 52. Thus when detent ring 60 is biased upwardly into engagement with nut flange 52, detent projections 64 slide into detent receiving deviations 54 and lock nut 50 to detent ring 60, and accordingly to column 20, for rotation therewith. Yet, detent projections 64 have gradually sloping sides, as do the detent receiving deviations 54, such that as nut 50 bottoms out at the bottom of tube 10 or comes to the top of threaded post 80, detent ring 60 can rotate in a slidable manner with respect to nut 50, i.e. with detent projections 64 sliding out of deviations 54 such that one cannot jam the mechanism against its top extreme or its bottom extreme.

In this regard, it is important that the bottom end of nut 50 extend a sufficient distance below the bottom of column 20 and/or ring 60 that when nut 50 bottoms out, there still is plenty of room for detent ring 60 to slide downwardly relative thereto as detent projections 64 slideout of detent receiving recess 64.

Bias washer 70, which is disposed between spring housing 30 and spring 40 on the one hand and the top of nut 50 on the other hand, helps to insure that nut 50 will not accidentally rotate when a person is seated in the chair. Bias washer 70 includes irregular upper and lower surfaces 71 and 72 respectively. The deviation 72 in the bottom surface are designed to mate with the projections 53 on the top surface of nut flange 52. Bias washers 70 include a small tab 73 which projects into slot 81 in threaded post 80 (FIG. 1). In this way, biasing washer 70 is fixed against rotation with respect to threaded spindle 80. When a person is seated in a chair, his weight forces column 20 down on top of spring housing 30 and spring 40, and those in turn press down on top biasing washer 70. Because of the mating deviations 72 and projections 53, biasing washer 70 helps insure that nut 50 will not rotate when column 20 is rotated. When the chair is unoccupied, there is very little weight on biasing washer 70 and the detent interaction of detent ring 60 with the undersurface of flange 52 on nut 50 is sufficient to overcome any frictional engagement between bias washer 70 and the top of flange 52 so that nut 50 will rotate when column 20 is rotated. This is why it is desirable that detent projections 64 and detent receiving recesses 54 are deeper and more sharply cammed than upper projections 53 and the deviations 72 in the bottom of bias washer 70.

The deviations 71 on the top of said bias washer 70 are identical to bottom deviations 72 and actually serve no particular function once bias washer 70 is installed. However, because there are equivelent deviations on either side of bias washer 70, installation is simplified in that it is impossible to get it in upside down.

Threaded post 80 is a threaded steel post. Because it does not have to carry any substantial lateral leverage which are carried by the telescopic engagement of column 20 with hub tube 10, threaded post 80 can be of a relatively narrow diameter and therefor considerably less expensive than the typical threaded spindle employed in chair bases. The typical threaded spindle comes down from the chair seat and has to take the lateral bending forces which in base 1 are carried by column 20.

As pointed out heretofor, a vertical slot 81 extends generally from the top to the bottom of threaded post 80. A stem 83 at the bottom of the threaded post 80 is relatively more narrower in diameter than the main body of post 80, and extends through an opening in bottom cap 15. There is a snap ring groove at the top of threaded post 80 for receiving a top snap ring 82 and another at the bottom thereof to receive a bottom snap ring 84 (FIG. 1). However, it has been found that top snap ring 82 and its attendant groove are not essential and can be deleted from a commercial embodiment.

To assemble the various components of the column subassembly, one first threads nut 50 onto threaded post 80 and then slips washer 70, spring 40 and spring housing 30 down over the top of threaded post 80 until they come to rest on the top flange 52 of nut 50.

Next, this entire sub-assembly is inserted into the opening of the bottom of seat column 20 until the shoulder 32 of spring housing 30 comes to rest against shoulder washer 22 in seat column 20. Detent ring 60 is then slipped over the bottom of threaded post 80 and is pushed up into the opening in the bottom of seat column 20 until projections 62 snap into apertures 23.

There are now two completed subassemblies. One comprises hub tube 10 with its appended base legs 11, and the other comprises seat column 20, spring housing 30, spring 40, nut 50, detent ring 60, bias washers 70 and threaded post 80. Final assembly involves the simple matter of inserting the seat column sub-assembly into the hub tube sub-assembly until stem 83 projects through the aperture in bottom cap 15 on hub tube 10, with key 17 inserted in slot 81. Snap ring 84 is then snapped into position on the bottom of threaded spindle 80 and the entire chair base 1 is ready for assembly to the rest of the chair.

In operation, the height of chair base 1 will not vary when a person sitting in the chair rotates column 20. The spring 40 will be compressed and detent ring 60 will be spaced a short distance below flange 52 of nut 50 as shown in FIG. 1. When a person gets off of the chair, spring 40 will force column 20 upwardly until detent projections 64 engage bottom recesses 54 in nut flange 52. Now when column 20 is rotated, nut 50 will thread upwardly or downwardly on threaded post 80 depending on the direction of rotation of column 20.

Of course, it is understood that the above is merely the preferred embodiment of the invention and that various changes and alterations can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A height adjustable chair base having a hub tube, a seat column telescopically positioned within said hub tube, and being operably carried on a nut which is located within said column and which nut is threaded on an externally threaded post located within said hub tube, in which the improvement comprises: abutment means connected with said column for supporting the same, and being disposed above said nut;

a spring housing slidably mounted on said post, and having an upper surface engaging said abutment means for supporting said seat column thereon, and a lower edge disposed adjacent to said nut;

spring means positioned within said spring housing and extending between said housing and said nut in an abutting relationship with both, whereby said spring housing and said column are biased upwardly relative to said nut;

said nut including first detent means opening toward the underside of said nut;

said column extending downwardly outside of said nut to a point below said first detent means on said nut; said column including second detent means located below said first detent means on said nut and shaped for mating engagement therewith; said threaded post being fixed against rotation within said hub tube; said spring means being sufficiently soft that when a chair mounted on said column is occupied by a person, said spring means compresses to diverge said first and second detent means, and converge the lower edge of said spring housing into abutment with said nut for positively supporting the weight of the chair and occupant thereon, but being sufficiently stiff that when the chair is unoccupied, said spring means biases said column upwardly and biases said first and second detent means into locking engagement, whereby when the chair and said column are rotated relative to said hub tube, said nut rotates on said threaded post to adjust the chair upwardly or downwardly depending on the direction of rotation thereof.

2. The chair base of claim 1 wherein said abutment means comprises: said column being lanced inwardly and a shoulder washer being positioned within said column and resting against said lanced portions of said column.

3. The chair base of claim 2 which includes: means biasing said nut against rotation with respect to said post when said spring is compressed by the weight of a person seated in a chair mounted on said chair base.

4. The chair base of claim 3 in which; said means biasing said nut against rotation with respect to said post when said spring is compressed comprises a washer corrugated at least on the bottom surface thereof and located between said spring means and said nut; said nut including a corregated upper surface mated with corregated bottom surface of said washer.

5. The chair base of claim 4 wherein said nut comprises a threaded sleeve having an upper radial flange projecting radially outwardly therefrom, said corregated upper surface of said nut comprising corregated deviations in the top surface of said flange.

6. The chair base of claim 5 in which: detent receiving means are located on the underside of said flange, said detent receiving means and said detent means combine to form a deeper mating engagement than said corregation in the upper surface of said flange and said corregation on said biasing washer whereby the interaction of detent means and said detent receiving means will override interaction of said biasing washer and said nut, and said nut will rotate with said column when said detent means engage said detent receiving means.

7. The chair base of claim 6 in which detent means comprises a ring secured in the bottom of said column, said ring including upwardly protruding detent projections; said detent receiving means comprising mating depressions in said nut.

8. The chair base of claim 7 wherein said detent ring includes prongs projecting laterally therefrom, said column including apertures receiving said prongs whereby said ring will snap fit into the bottom of said column.

9. The chair base of claim 8 which includes quick fastening means for securing said threaded spindle to the bottom of said hub tube whereby said seat column, said spring means, said nut, said detent means and said threaded spindle can be assembled as a single sub-assembly and then readily inserted into and secured to said hub tube.

10. The chair base of claim 9 wherein said spring housing includes a collar at the upper end thereof surrounding said threaded post, said collar including a projection projecting inwardly therefrom, said threaded post including a vertical slot extending generally from the top to the bottom thereof, said projection extending into said vertical slot whereby said spring housing is fixed against rotation with respect to the threaded post which slides up and down thereon.

11. The chair base of claim 10 wherein said spring housing is molded of plastic.

12. The chair base of claim 11 wherein said detent ring is molded of plastic.

13. The chair base of claim 12 wherein said bias washer is mold of plastic.

14. The chair base of claim 1, or 2 wherein said nut comprises a threaded sleeve having an upper radial flange projecting radially outwardly therefrom, said corrugated upper surface of said nut comprising corrugated deviations in the top surface of said flange.

15. The chair base of claim 14 in which: detent receiving means are located on the underside of said flange, said detent receiving means and said detent means combine to form a deeper mating engagement than said corregation in the upper surface of said flange and said corregation on said biasing washer whereby the interaction of detent means and said detent receiving means will override interaction of said biasing washer and said nut, and said nut will rotate with said column when said detent means engage said detent receiving means.

16. The chair base of claim 1 or 2 in which detent means comprises a ring secured in the bottom of said column, said ring including upwardly protruding detent projections; said detent receiving means comprising mating depressions in said nut.

17. The chair base of claim 16 wherein said detent ring includes prongs projecting laterally therefrom, said column including apertures receiving said prongs whereby said ring will snap fit into the bottom of said column.

18. The chair base of claim 17 which includes quick fastening means for securing said threaded spindle to the bottom of said hub tube whereby said seat column, said spring means, said nut, said detent means and said threaded spindle can be assembled as a single sub-assembly and then readily inserted into and secured to said hub tube.

19. The chair base of claim 18 wherein said detent ring is molded of plastic.

20. The chair base of claim 1, 2, 3, 4, 5, 6 or 7 which includes quick fastening means for securing said threaded spindle to the bottom of said hub tube whereby said seat column, said spring means, said nut, said detent means and said threaded spindle can be assembled as a single sub-assembly and then readily inserted into and secured to said hub tube.

21. A height adjustable chair base having a hub tube, a seat column telescopically positioned within said hub tube and being operably carried on a nut which is located within said column and which is threaded on an externally threaded post located within said hub tube, in which the improvement comprises: said column including an abutment shoulder at a point spaced from its bottom; said column extending downwardly beyond said shoulder and having an open bottom, the diameter of said open bottom and said column below said shoulder being generally constant whereby components of said chair base can be readily inserted into said opening and up into said column below said shoulder a spring housing positioned within said column abutting said shoulder said spring housing being rotatable with respect to said column; a spring located within said housing; said externally threaded post extending upwardly through said spring and said spring housing; said spring housing being fixed against rotation with respect to said threaded post but being slidable vertically thereon; said nut being threaded on said threaded post, said nut being located below said spring and spring housing, the bottom of said spring engaging the top of said nut; a detent ring secured within the bottom of said column, said detent ring and said column including mating quick fastening means whereby said detent ring can be quickly secured within the bottom of said column, said detent ring projecting radially inwardly from the inside wall of said column and including an aperture therethrough through which said threaded post passes; said detent means being located below said nut whereby when said detent ring is secured in position, said column, said threaded post, said nut, said spring housing and said spring are secured together as a subassembly; said detent ring including upwardly protruding detent projections, said nut including mating detent receiving depressions on the bottom thereof for engagement by said detent projections; said threaded post being fixed against rotation with respect to said hub tube; said threaded post extending through an aperture in the bottom of said hub tube; quick fastening means securing said threaded spindle to said bottom of said hub tube whereby said seat column, said spring, said spring housing, said nut, said detent ring and said threaded spindle can readily be inserted to and secured to said hub tube; said spring means being sufficiently soft that it compresses when a chair mounted on said column is occupied by a person, but being sufficiently stiff that when the chair is unoccupied, said spring biases said column upwardly and biases said detent projections into engagement with said detent receiving recesses on said nut whereby when the chair seat and said column are rotated, said nut rotates on said threaded post to adjust the chair upwardly or downwardly depending on the direction of rotation thereof.

22. The chair base of claim 21 which includes: means biasing said nut against rotation with respect to said post when said spring is compressed by the weight of a person seated in a chair mounted on said chair base.

23. The chair base of claim 21 which includes: means biasing said nut against rotation with respect to said post when said spring is compressed by the weight of a person seated in a chair mounted on said chair base.

24. The chair base of claim 23 in which: said means biasing said nut against rotation with respect to said post when said spring is compressed comprises a washer corregated at least on the bottom surface thereof and located between said spring means and said nut; said nut including a corregated upper surface mated with corregated bottom surface of said washer.

25. The chair base of claim 24 wherein said nut comprises a threaded sleeve having an upper radial flange projecting radially outwardly therefrom, said corregated upper surface of said nut comprising corregated deviations in the top surface of said flange.

26. The chair base of claim 25 in which: detent receiving recesses are located on the underside of said flange, said detent receiving recesses and said detent projections combine to form a deeper mating engagement than said corregation in the upper surface of said flange and said corregation on said biasing washer whereby the interaction of detent means and said detent receiving means will override interaction of said biasing washer and said nut, and said nut will rotate with said column when said detent means engage said detent receiving means.

27. The chair base of claim 21, 22 or 26 wherein said detent ring includes prongs projecting laterally therefrom, said column including apertures receiving said prongs whereby said ring will snap fit into the bottom of said column.

28. The chair base of claim 27 wherein said spring housing includes a collar at the upper end thereof surrounding said threaded post, said collar including a projection projecting inwardly therefrom, said threaded post including a vertical slot extending generally from the top to the bottom thereof, said projection extending into said vertical slot whereby said spring housing is fixed against rotation with respect to the threaded post which slides up and down thereon.

29. The chair base of claim 21 wherein said spring housing includes a collar at the upper end thereof surrounding said threaded post, said collar including a projection projecting inwardly therefrom, said threaded post including a vertical slot extending generally from the top to the bottom thereof, said projection extending into said vertical slot whereby said spring housing is fixed against rotation with respect to the threaded post which slides up and down thereon.

* * * * *

UNITED STATES PATENT AND TRADEMARK OFFICE

CERTIFICATE OF CORRECTION

PATENT NO. : 4,324,382

DATED : April 13, 1982

INVENTOR(S) : Duane M. Beukema et al.

It is certified that error appears in the above—identified patent and that said Letters Patent is hereby corrected as shown below:

Column 1, line 26:

"chain braces" should be --chair braces--

Column 1, line 55:

"2,792,975" should be --2,702,075--

Column 4, line 29:

"snuggly" should be --snugly--

Column 5, line 33:

"slideout" should be --slide out--

Column 5, line 64:

"equivelent" should be --equivalent--

Column 6, line 3:

"therefor" should be --therefore--

Column 6, line 9:

"heretofor" should be --heretofore--

Column 7, Claim 5, line 55:

"corregated" should be --corrugated--

UNITED STATES PATENT AND TRADEMARK OFFICE

CERTIFICATE OF CORRECTION

PATENT NO. : 4,324,382 PAGE 2 OF 2

DATED : April 13, 1982

INVENTOR(S) : Duane M. Beukema et al.

It is certified that error appears in the above—identified patent and that said Letters Patent is hereby corrected as shown below:

Column 7, Claim 6, lines 61 and 62:

"corregation" should be --corrugation--

Column 8, Claim 13, line 30:

"mold" should be --molded--

Column 8, Claim 15, lines 40 and 41:

"corregation" should be --corrugation--

Column 10, Claim 24, lines 14, 16 and 17:

"corregated" should be --corrugated--

Column 10, Claim 25, lines 20 and 21:

"corregated" should be --corrugated--

Column 10, Claim 26, lines 27 and 28:

"corregation" should be --corrugation--

Signed and Sealed this

*Third* Day of *August 1982*

[SEAL]

*Attest:*

GERALD J. MOSSINGHOFF

*Attesting Officer*

*Commissioner of Patents and Trademarks*